US010741967B2

(12) United States Patent
Zheng

(10) Patent No.: US 10,741,967 B2
(45) Date of Patent: Aug. 11, 2020

(54) ELECTRICAL CONNECTOR ASSEMBLY AND ELECTRICAL CONNECTOR

(71) Applicant: Molex, LLC, Lisle, IL (US)

(72) Inventor: You-Xiang Zheng, Pudong (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 16/134,575

(22) Filed: Sep. 18, 2018

(65) Prior Publication Data

US 2019/0097354 A1 Mar. 28, 2019

(30) Foreign Application Priority Data

Sep. 22, 2017 (CN) ..... 2017 1 0867774

(51) Int. Cl.
*H01R 13/627* (2006.01)
*H01R 24/60* (2011.01)
(Continued)

(52) U.S. Cl.
CPC ..... *H01R 13/6272* (2013.01); *H01R 13/506* (2013.01); *H01R 24/60* (2013.01); *H01R 2107/00* (2013.01)

(58) Field of Classification Search
CPC .... H01R 13/6271–6273; H01R 13/506; H01R 24/60; H01R 2107/00
(Continued)

(56) References Cited

U.S. PATENT DOCUMENTS 5,203,719 A * 4/1993 Kozono ..... H01R 13/6272 439/357
5,295,855 A * 3/1994 Walz ..... H01R 13/6272 285/319
(Continued)

FOREIGN PATENT DOCUMENTS

CN 202601982 U 12/2012
CN 104134900 A 11/2014
(Continued)

OTHER PUBLICATIONS

Notification of Reasons for refusal received for JP application No. 2018-172022, dated Sep. 17, 2019, 10 pages. (5 pages of English translation and 5 pages of official copy).

*Primary Examiner* — Gary F Paumen
(74) *Attorney, Agent, or Firm* — Molex, LLC

(57) ABSTRACT

The present disclosure provides an electrical connector, which comprises an insulating base portion, a mating portion, a latching portion and a limiting block. The insulating base portion has a front end, a rear end and a top surface; the mating portion extends forwardly from the front end of the insulating base portion; the latching portion is integrally formed to the top surface of the insulating base portion, the latching portion comprises a latching arm and a latching block, a rear end of the latching arm is connected to a rear end of the top surface of the insulating base portion, and the latching arm extends forwardly with the rear end of the latching arm as a fulcrum to form a cantilever structure; the latching block is formed to a front end of the latching arm and protrudes upwardly; the limiting block is provided on the top surface of the insulating base portion and positioned below the latching arm, the limiting block has a top face; a first gap is provided between the top surface of the insulating base portion and a bottom surface of the latching arm, a second gap is provided between the top face of the limiting block and the bottom surface of the latching arm, the second gap is less than the first gap, the limiting block is used to limit a distance that the latching arm is displaced downwardly.

9 Claims, 8 Drawing Sheets

(51) Int. Cl.
*H01R 107/00* (2006.01)
*H01R 13/506* (2006.01)

(58) Field of Classification Search
USPC ..... 439/353, 358, 357, 677
See application file for complete search history.

(56) References Cited

U.S. PATENT DOCUMENTS 5,310,358 A * 5/1994 Johnson ..... G06F 1/1632 361/679.41
5,342,221 A * 8/1994 Peterson ..... H01R 13/514 439/677
5,584,719 A 12/1996 Tsuji et al.
6,352,444 B1 * 3/2002 Yuzawa ..... H01R 13/514 385/56
7,232,329 B1 * 6/2007 Wu ..... H01R 12/62 439/358
7,255,607 B1 8/2007 Wu
7,686,638 B2 * 3/2010 Boyd ..... H01R 13/6272 439/344
8,052,458 B2 * 11/2011 Rossman ..... H01R 13/6456 439/358
2004/0043654 A1 * 3/2004 Lee ..... H01R 13/6275 439/358
2007/0026721 A1 * 2/2007 Whyne ..... H01R 13/6273 439/358
2011/0250778 A1 10/2011 Wu
2013/0084732 A1 * 4/2013 Zhang ..... H01R 13/6275 439/353
2016/0164212 A1 * 6/2016 Iihoshi ..... H01R 13/4223 439/357
2017/0250508 A1 8/2017 Yu et al.

FOREIGN PATENT DOCUMENTS

CN 104283060 A 1/2015
CN 107069334 A 8/2017
DE 202005019275 U1 3/2006
JP S49-102290 U 9/1974
JP S56-000077 U 1/1981
JP S61-63782 U 4/1986
JP S62-25479 U 2/1987
JP H01-119180 U 8/1989
JP H02-54180 U 4/1990
JP H07-307185 A 11/1995
JP 2009-272278 A 11/2009
TW M357070 5/2009
TW 201405961 A 2/2014

* cited by examiner

ELECTRICAL CONNECTOR ASSEMBLY AND ELECTRICAL CONNECTOR

RELATED APPLICATIONS

This application claims priority to Chinese Application No. 201710867774.8, filed Sep. 22, 2017, which is incorporated herein by reference in its entirety.

TECHNICAL FIELD

The present disclosure relates to an electrical connector assembly and an electrical connector.

BACKGROUND ART

An electrical connector assembly is used in a variety of industrial applications, typically includes two electrical connectors which are assembled to each other, in order to ensure a stable electrical connection, the two electrical connectors also require a certain physical connection, besides that housings and even parts of insulators of the two electrical connectors are connected to each other, one of the two electrical connectors is further provided with an elastic connection structure.

Chinese patent application No. 201010552654.7 (corresponding to U.S. Pat. No. 8,052,458) discloses an electrical connector assembly which comprises a plug connector and a mating connector. The plug connector comprises a housing, the housing has a base and a contact tower and an elastic latch extending forwardly from a front end of the base, the elastic latch is positioned above the contact tower, the elastic latch may be deflectable. Both sides of a rear end of the base are respectively provided with second finger grips, the plug connector is connected to the mating connector and the elastic latch is allowed to lock the mating connector by means of gripping the second finger grips. A front end of the base is provided with a first finger grip, the first finger grip is aligned with the elastic latch, and the elastic latch may be deflected by pushing the first finger grip downwardly, so that the elastic latch is released. Flanges extend upwardly from outer sides of the tops of the outermost contact towers, the flanges at least partially block a gap between the bottom of the elastic latch and the tops of the contact towers to prevent from being entangled by a cable.

Although the above patent discloses an elastic latch configuration, when the force applied downwardly to the elastic latch is too large, the elastic latch is excessively deflected downwardly, it may cause deformation or damage of the elastic latch; while the elastic latch is excessively deflected upwardly, it may also cause deformation or damage of the elastic latch.

SUMMARY

A technical problem to be solved by the present disclosure is to provide an electrical connector assembly and an electrical connector in which a latching arm is not easily deformed or damaged so as to overcome the deficiency in the prior art as described above.

In view of the above technical problem, the present disclosure provides an electrical connector, which comprises an insulating base portion, a mating portion, a latching portion and a limiting block. The insulating base portion has a front end, a rear end opposite to the front end and a top surface; the mating portion extends forwardly from the front end of the insulating base portion; the latching portion is integrally formed to the top surface of the insulating base portion, the latching portion comprises a latching arm and a latching block, a rear end of the latching arm is connected to a rear end of the top surface of the insulating base portion, and the latching arm extends forwardly with the rear end of the latching arm as a fulcrum to form a cantilever structure; the latching block is formed to a front end of the latching arm and protrudes upwardly; the limiting block is provided on the top surface of the insulating base portion and positioned below the latching arm, the limiting block has a top face; a first gap is provided between the top surface of the insulating base portion and a bottom surface of the latching arm, a second gap is provided between the top face of the limiting block and the bottom surface of the latching arm, the second gap is less than the first gap, the limiting block is used to limit a distance that the latching arm is displaced downwardly.

According to another aspect of the present disclosure, an electrical connector assembly comprises an electrical connector and a mating connector which are assembled to each other, wherein the electrical connector is the electrical connector of present disclosure.

Compared with the prior art, the present disclosure has the following efforts.

In the electrical connector of the present disclosure, the top surface of the insulating body below the latching arm is provided with the limiting block, the limiting block functions as stopping, may prevent the latching arm from being excessively pressed downwardly to cause deformation or damage of the latching arm.

Further, in some embodiments, the upper limiting block positioned between the unlock force-applying portion and the latching block functions as stopping, may prevent the latching arm from being excessively pulled upwardly to cause deformation or damage of the latching arm. With the limiting block and the upper limiting block, the displacement of the latching arm in an up-down direction may be limited to prevent the latching arm from deformation or damage. The side barrier walls play a role of preventing the cable from entering into between the latching arm and the top surface of the insulating base portion, avoiding the risk of rupture of the latching arm due to entanglement of a cable after the latching arm is locked.

BRIEF DESCRIPTION OF THE DRAWINGS

The other features and effects of the present disclosure will be apparent through the embodiments in combination with the figures, and.

DETAILED DESCRIPTION OF THE PREFERRED EMBODIMENTS

While the present disclosure may be susceptible to embodiments in different forms, there are shown in the figures, and will be described herein in detail, are only specific embodiments, with the understanding that the present disclosure is to be considered as an exemplification of the principles of the present disclosure, and is not intended to limit the present disclosure to that as illustrated.

As such, references to a feature are intended to describe a feature of an example of the present disclosure, not to imply that every embodiment thereof must have the described feature. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the figures, representations of directions such as up, down, left, right, front and rear, used for explaining the structure and movement of the various parts of the present disclosure, are not absolute, but relative. These representations are appropriate when the parts are in the position shown in the figures. If the description of the position of the parts changes, these representations are to be changed accordingly.

Figure 1:
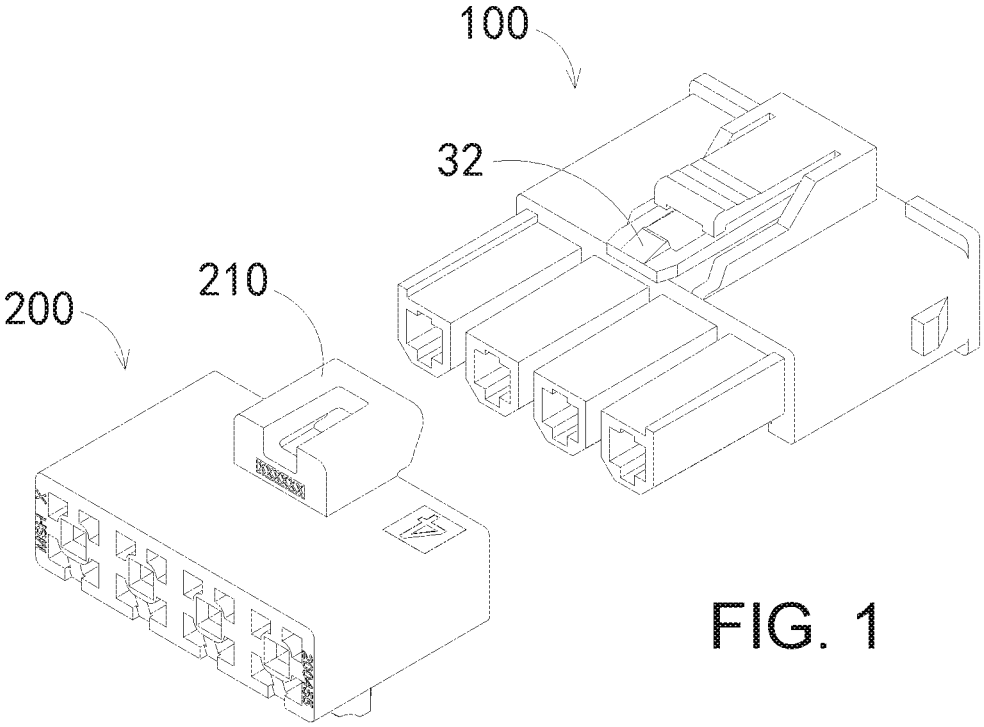
FIG. 1 is an exploded perspective view of an electrical connector assembly in the present disclosure.
Figure 2:
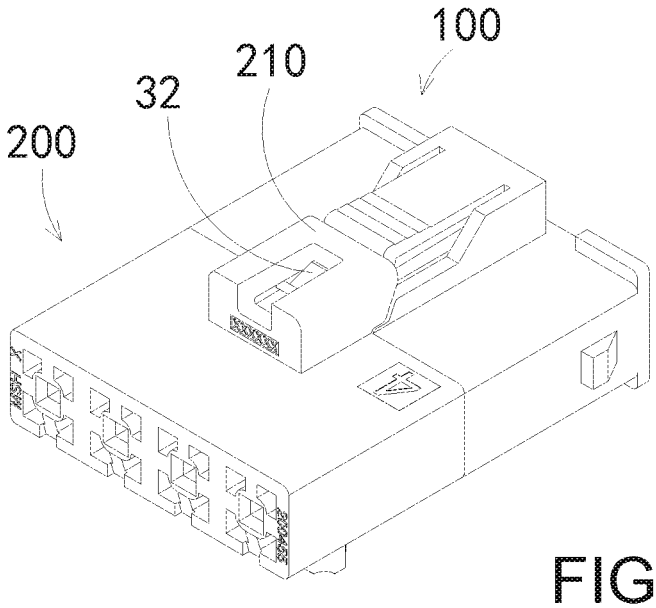
FIG. 2 is an assembled perspective view of the electrical connector assembly shown in FIG. 1.

Referring to FIG. 1 and FIG. 2, FIG. 1 is an exploded perspective view of an electrical connector assembly in the present disclosure; FIG. 2 is an assembled perspective view of the electrical connector assembly shown in FIG. 1. The electrical connector assembly is used in a variety of industrial applications and typically comprises two electrical connectors which are assembled to each other, for example an electrical connector 100 and a mating connector 200. In order to ensure a stable electrical connection, besides that housings and even parts of insulators of the electrical connector 100 and the mating connector 200 are connected to each other, the electrical connector 100 is further provided with an elastic connection structure. The elastic connection structure comprises a latching block 32, the mating connector 200 is provided with a latching portion 210, and the latching block 32 can be locked to the latching portion 210, so that the electrical connector 100 and the mating connector 200 are connected more firmly. When the electrical connector 100 and the mating connector 200 are required to separate from each other, the latching block 32 is detached from the latching portion 210 firstly, and then the electrical connector 100 is separated from the mating connector 200. The electrical connector 100 in the present disclosure, for example, can be a plug connector, the mating connector 200 can be a receptacle electrical connector; specific embodiments of the electrical connector 100 in the present disclosure will be described in detail.

Figure 3:
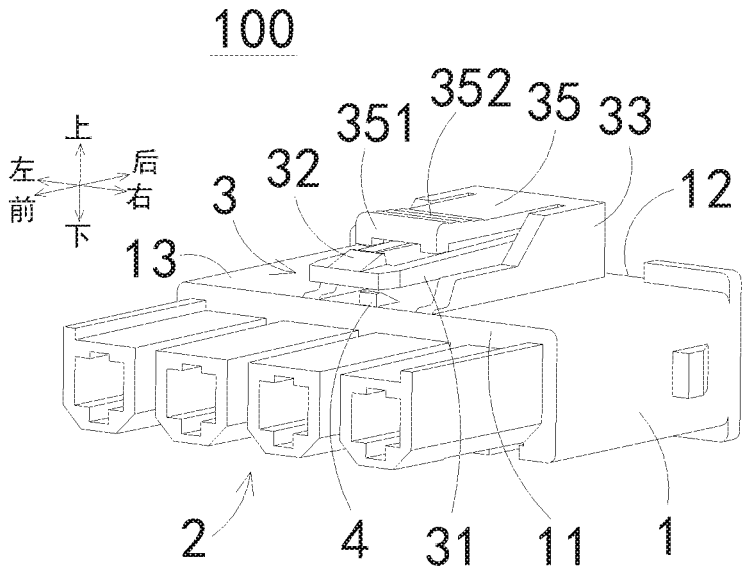
FIG. 3 is a perspective view of a first embodiment of an electrical connector in the present disclosure from an angle.
Figure 4:
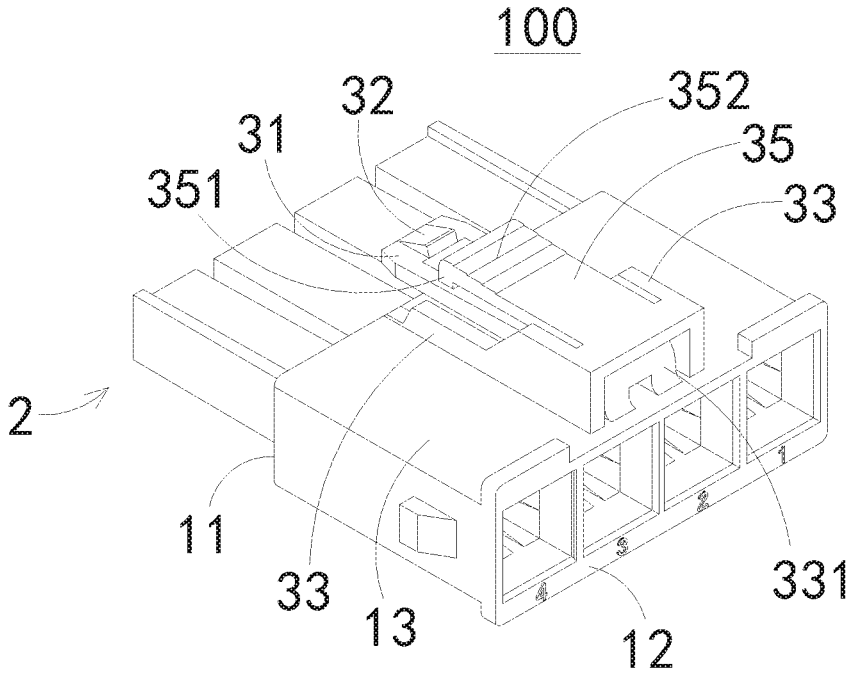
FIG. 4 is a perspective view of the electrical connector shown in FIG. 3 from another angle.
Figure 5:
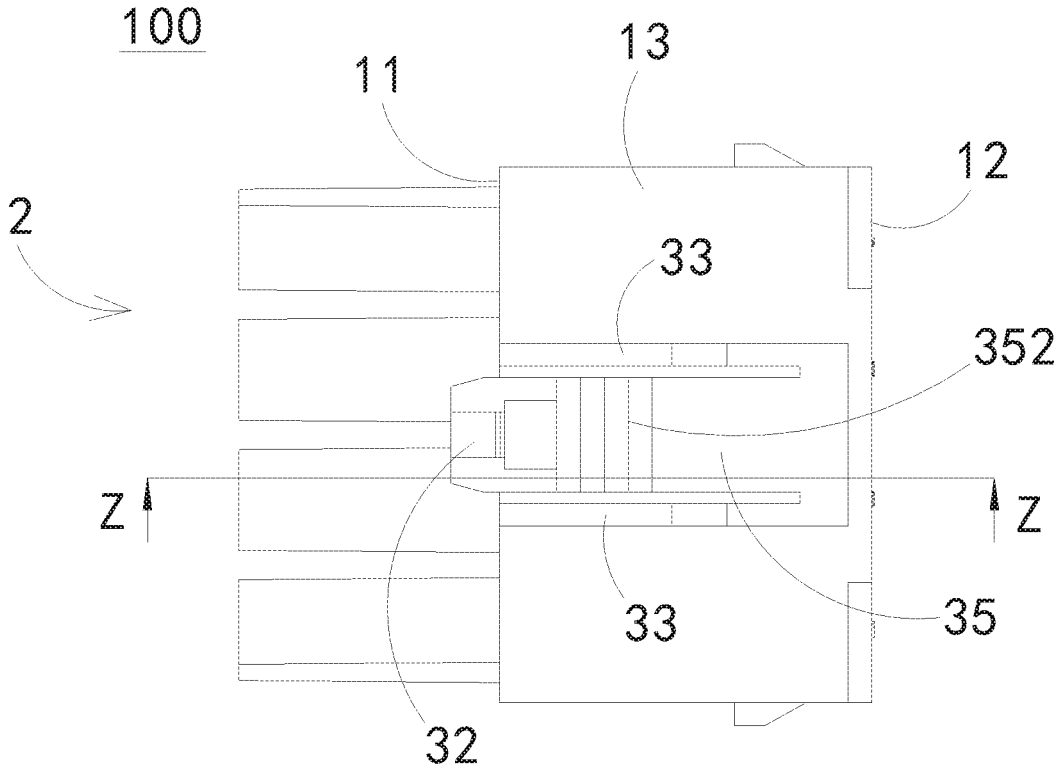
FIG. 5 is a top view of the electrical connector shown in FIG. 3.
Figure 6:
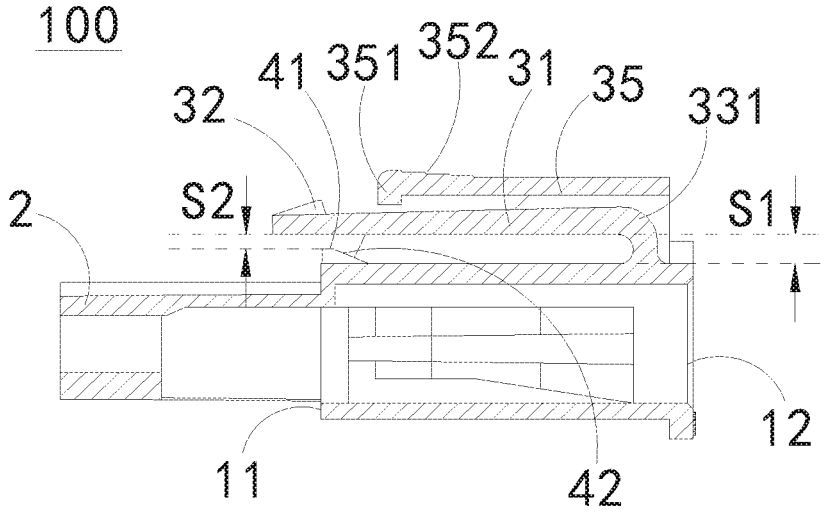
FIG. 6 is a cross-sectional view taken along a Z-Z line in FIG. 5.

Referring to FIG. 3 to FIG. 6, FIG. 3 is a perspective view of a first embodiment of an electrical connector in the present disclosure from an angle; FIG. 4 is a perspective view of the electrical connector shown in FIG. 3 from another angle; FIG. 5 is a top view of the electrical connector shown in FIG. 3; FIG. 6 is a cross-sectional view taken along a Z-Z line in FIG.

As shown in FIG. 3 to FIG. 6, a first embodiment of the electrical connector 100 in the present disclosure comprises an insulating base portion 1, a mating portion 2, a latching portion 3 and a limiting block 4.

The insulating base portion 1 has a front end 11, a rear end 12 opposite to the front end 11 and a top surface 13. The mating portion 2 extends forwardly from the front end 11 of the insulating base portion 1, and can be inserted into an accommodating cavity of the mating connector to realize an electrical connection via interconnection of a plurality of conductive terminals (not shown in figures).

The latching portion 3 is integrally formed with the insulating base portion 1 and is positioned on the top surface 13 of the insulating base portion 1. In the first embodiment, the latching portion 3 comprises a latching arm 31 and a latching block 32. A rear end 331 of the latching arm 31 is connected to a rear end of the top surface 13 of the insulating base portion 1 and the latching arm 31 extends forwardly with the rear end 331 of the latching arm 31 as a fulcrum to form a cantilever structure, a first gap S1 (see FIG. 6) is provided between the latching arm 31 and the top surface 13 of the insulating base portion 1. The latching block 32 is formed to a front end of the latching arm 31 and protrudes upwardly.

The limiting block 4 is provided on the top surface 13 of the insulating base portion 1, the limiting block 4 may be integrally formed with the insulating base portion 1, or the limiting block 4 may be an independent structure which can be fixed on the top surface 13 of the insulating base portion 1 by means of adhering and the like. In an embodiment, the limiting block 4 has a top face 41 and an inclined surface 42 positioned behind the top face 41 and extending backwardly and downwardly (as shown in FIG. 3 and FIG. 6). The limiting block 4 is positioned below the latching arm 31, a second gap S2 is provided between the top face 41 of the limiting block 4 and a bottom surface of the latching arm 31, the second gap S2 is less than the first gap S1, the limiting block 4 is used to limit a distance that the latching arm 31 is displaced downwardly. When a downward displacement of the latching arm 31 toward the top face 41 of the limiting block 4 exceeds a distance defined by the second gap S2, the limiting block 4 functions as stopping, that is, preventing the latching arm 31 from being excessively displaced downwardly to cause deformation or damage of the latching arm 31.

Specifically, the limiting block 4 may be positioned on the middle of the top surface 13 of the insulating base portion 1 in a left-right direction and close to the front end 11 of the insulating base portion 1; further, the limiting block 4 is positioned behind a projection of the latching block 32 on the top surface 13 of the insulating base portion 1.

Further, the latching portion 3 further comprises two side barrier walls 33, the two side barrier walls 33 are respectively positioned at a left side and a right side of the latching arm 31 to cover at least a part of the first gap S1 between the latching arm 31 and the top surface 13 of the insulating base portion 1. The side barrier walls 33 is beneficial to prevent a cable connected to the electrical connector 100 from entering into between the latching arm 31 and the top surface 13 of the insulating base portion 1 to cause the risk of rupture of the latching arm 31.

In an embodiment, the latching portion 3 further comprises an unlock force-applying portion, the unlock force-applying portion is positioned between the rear end 331 of the latching arm 31 and the latching block 32 and is positioned behind the limiting block 4, in other words, the limiting block 4 is positioned between the latching block 32 and the unlock force-applying portion. The latching arm 31 is deflected downwardly and the latching block 32 is detached from a locking position by applying a force to the unlock force-applying portion so as to easy to separate the two electrical connectors which are mated to each other. Further explanation, when the force is applied to the unlock force-applying portion, the latching arm 31 suffers the force and the cantilever structure is deflected downwardly with the rear end 331 of the latching arm 31 as a fulcrum, the latching block 32 may be detached from the locking position, when the latching arm 31 is deflected downwardly and exceeds a distance defined by the second gap S2, a part of the bottom surface of the latching arm 31 is abutted against by the top face 41 of the limiting block 4, at this position, if a user continues to apply the force, the user will feel that a reacting force increases obviously, the increased reacting force makes the user to recognize that he/she should no longer continuously apply the force downwardly, to prevent the latching arm 31 from being ruptured; even if the user does not recognize it and continuously apply the force downwardly, a part of the latching arm 31 between the rear end 331 thereof as a fulcrum and the limiting block 4 as a fulcrum will be deflected downwardly, the bottom surface of the part of the latching arm 31 will be supported by the inclined surface 42 of the limiting block 4, increasing a force contact area between the latching arm 31 and the limiting block 4, the fulcrum of the latching arm 31 on the limiting block 4 is moved backwardly, further increasing the reacting force, which makes the user feel strongly, and beneficial to prevent the latching arm 31 from being ruptured.

In the first embodiment, the unlock force-applying portion is a force-applying elastic arm 35, a front end portion of the force-applying elastic arm 35 has a protruding portion 351 bent toward the latching arm 31, a rear end portion of the force-applying elastic arm 35 is connected to the rear end of the top surface 13 of the insulating base portion 1, for example, left and right sides of the rear end portion of the force-applying elastic arm 35 are respectively connected to rear ends of the side barrier walls 33, such a connection is firm, not easy to damage, and easy to operate. The force-applying elastic arm 35 is provided above the latching arm 31, and a gap is provided between the force-applying elastic arm 35 and the latching arm 31, the protruding portion 351 is positioned behind the limiting block 4 and functions as a force-applying point of the force-applying elastic arm 35 to the latching arm 31. The force-applying elastic arm 35 allows the latching arm 31 to be slightly deflected upwardly on the one hand, and prevents the latching arm 31 from being excessively deflected upwardly and damaged on the other hand.

The first embodiment of the electrical connector in the present disclosure is a double elastic arm structure, the force-applying elastic arm 35 is separated from the latching arm 31 completely, an external force for unlocking through the force-applying elastic arm 35 is transferred to the latching arm 31 via the protruding portion 351.

Furthermore, on a top surface of the force-applying elastic arm 35 close to a front end (that is a top surface close to the protruding portion 351), an anti-slip structure with a plurality of parallel protruding bars 352 or other similar rough surfaces as shown in figures can be provided to facilitate force-applying by contact from the user's finger.

Figure 7:
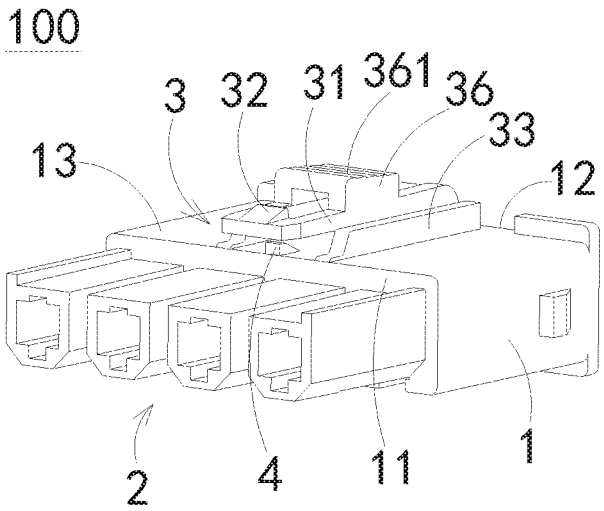
FIG. 7 is a perspective view of a second embodiment of the electrical connector in the present disclosure from an angle.
Figure 8:
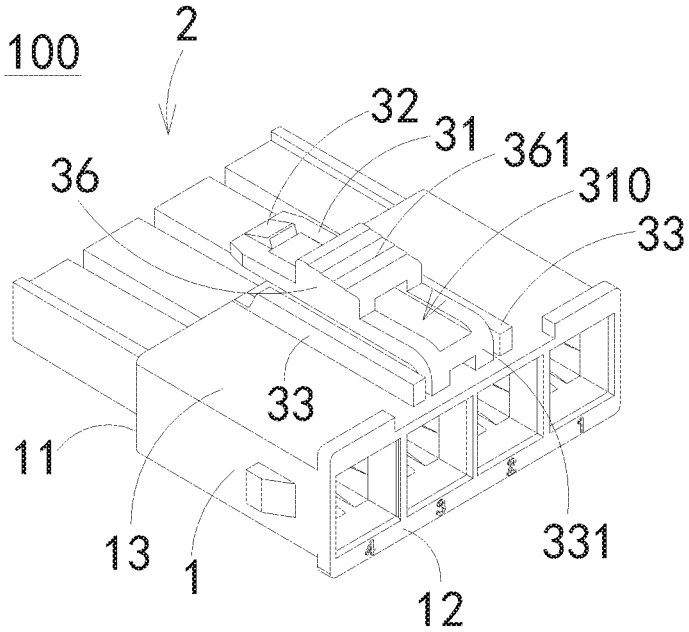
FIG. 8 is a perspective view of the electrical connector shown in FIG. 7 from another angle.

Referring to FIG. 7 to FIG. 8, FIG. 7 is a perspective view of a second embodiment of the electrical connector in the present disclosure from an angle; FIG. 8 is a perspective view of the electrical connector shown in FIG. 7 from another angle.

The difference between the second embodiment of the electrical connector in the present disclosure and the first embodiment lies in that: the unlock force-applying portion is an operating protrusion 36 integrally provided to an upper surface of the latching arm 31, the operating protrusion 36 may be for example a rectangle block structure. When the latching block 32 is required to detach from the locking position, a downward force is applied to the operating protrusion 36. The operating protrusion 36 makes unlocking easy to operate, and an upper surface of the operating protrusion 36 may be provided with the anti-slip structure with the parallel protruding bars 361 or the other similar rough surfaces.

Further, the latching arm 31 is provided with a long hole 310 along a front-rear direction, the long hole 310 can increase elasticity of the latching arm 31. The latching block 32 is positioned in front of the long hole 310, left and right sides of a bottom of the operating protrusion 36 are respectively connected to both sides of the long hole 310 of the latching arm 31.

Other structures of the second embodiment of the electrical connector in the present disclosure are substantially the same as those of the first embodiment, which are omitted herein.

Figure 9:
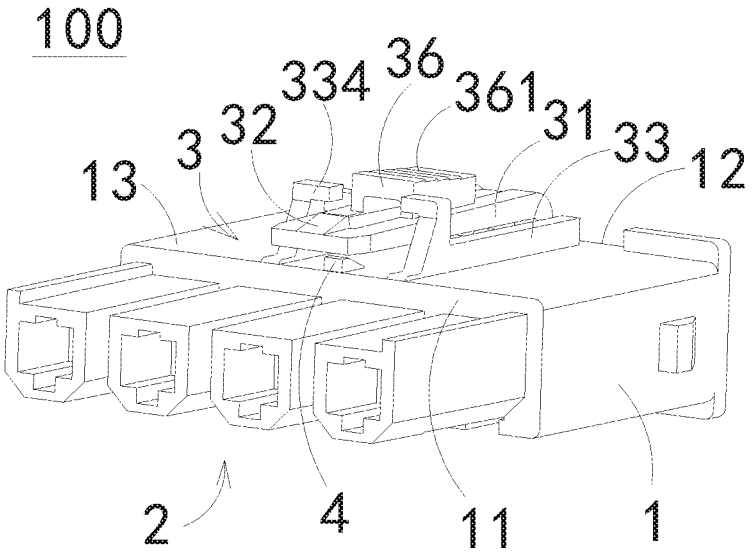
FIG. 9 is a perspective view of a third embodiment of the electrical connector in the present disclosure from an angle.
Figure 10:
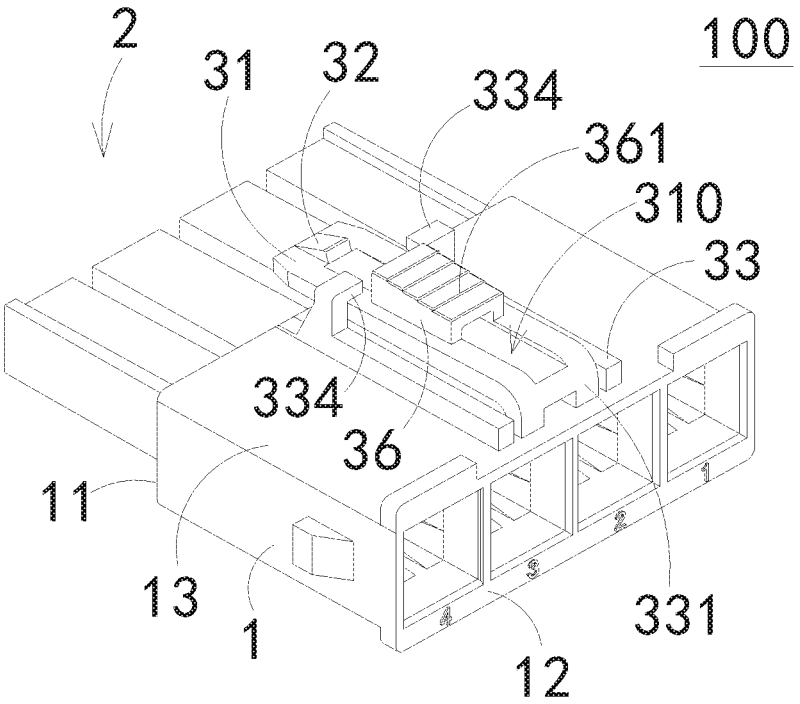
FIG. 10 is a perspective view of the electrical connector shown in FIG. 9 from another angle.

Referring to FIG. 9 to FIG. 10, FIG. 9 is a perspective view of a third embodiment of the electrical connector in the present disclosure from an angle; FIG. 10 is a perspective view of the electrical connector shown in FIG. 9 from another angle.

The difference between the third embodiment of the electrical connector in the present disclosure and the second embodiment lies in that: the two side barrier walls 33 are respectively provided with two upper limiting blocks 334 which are positioned above the upper surface of the latching arm 31 and face each other, the two upper limiting blocks 334 are positioned between the operating protrusion 36 and the latching block 32. The upper limiting blocks 334 may prevent the latching arm 31 from excessively warping upwardly and deformation or damage.

Other structures of the third embodiment of the electrical connector in the present disclosure are substantially the same as those of the second embodiment, which are omitted herein.

Figure 11A:
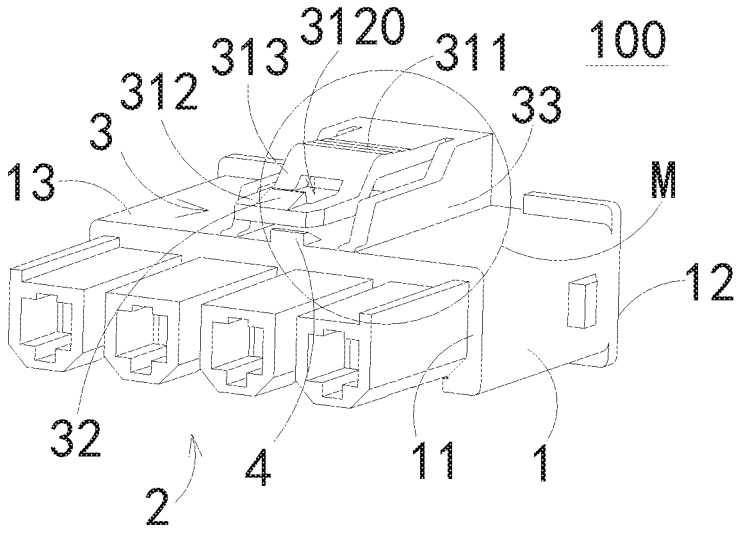
FIG. 11A is a perspective view of a fourth embodiment of the electrical connector in the present disclosure from an angle.
Figure 11B:
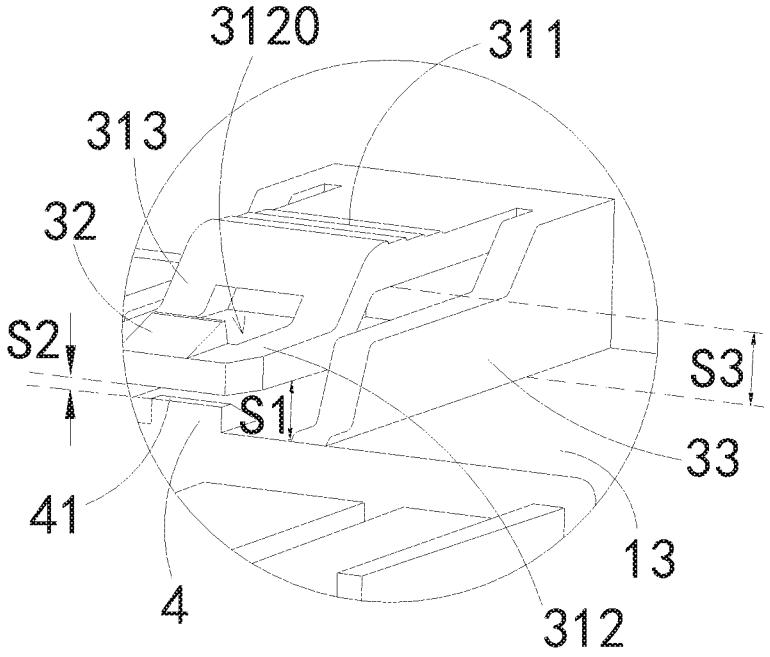
FIG. 11B is an enlarged view of a portion M in FIG. 11A.
Figure 12:
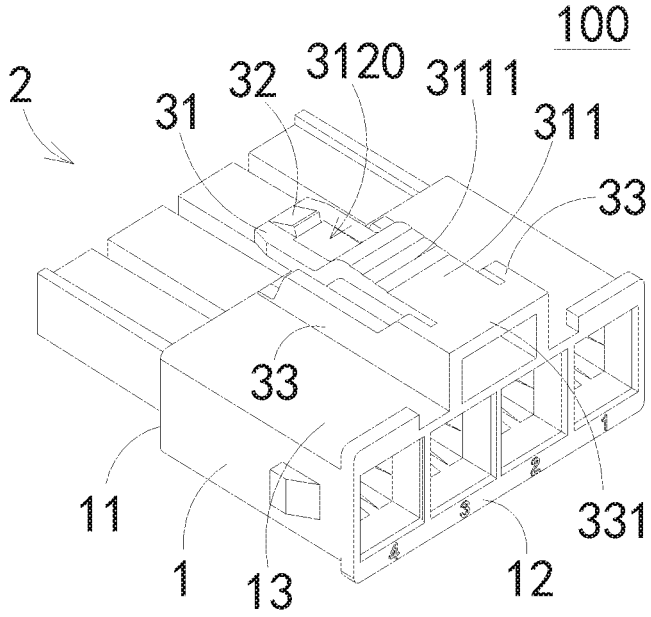
FIG. 12 is a perspective view of the electrical connector shown in FIG. 11A from another angle.

Referring to FIG. 11A to FIG. 12, FIG. 11A is a perspective view of a fourth embodiment of the electrical connector in the present disclosure from an angle; FIG. 11B is an enlarged view of a portion M in FIG. 11A; FIG. 12 is a perspective view of the electrical connector shown in FIG. 11A from another angle.

The difference between the fourth embodiment of the electrical connector in the present disclosure and the first embodiment lies in that: the latching arm 31 is a stepped elastic arm, and comprises a rear high platform portion 311, a front low platform portion 312 and an inclined connecting portion 313 connected between the rear high platform portion 311 and the front low platform portion 312. The latching block 32 is formed to the front low platform portion 312, left and right sides of the rear end 331 of the latching arm 31, that is left and right sides of a rear end portion of the rear high platform portion 311, are respectively connected to the two side barrier walls 33. In a varied embodiment, the rear end 331 of the latching arm 31, that is the rear end portion of the rear high platform portion 311, can be directly connected to the top surface 13 of the insulating base portion 1. A gap between the front low platform portion 312 and the top surface 13 of the insulating base portion 1 is a first gap S1 (see FIG. 11B), a gap between the rear high platform portion 311 and the top surface 13 of the insulating base portion 1 is a third gap S3, the first gap S1 is less than the third gap S3. The two side barrier walls 33 are respectively positioned at the left side and the right side of the latching arm 31 to cover at least a part of the first gap S1 and at least a part of the third gap S3 between the latching arm 31 and the top surface 13. In the embodiment, the second gap S2 between the top face 41 of the limiting block 4 and the bottom surface of the latching arm 31 is less than the first gap S1, the limiting block 4 is used to limit a displacement distance of the latching arm 31 downwardly. The limiting block 4 functions as stopping, that is preventing the latching arm 31 from excessively displacing downwardly to cause deformation or damage of the latching arm 31.

A long hole 3120 may be provided on the inclined connecting portion 313 and the front low platform portion 312, and the long hole 3120 can increase elasticity of the latching arm 31. The latching block 32 is positioned in front of the long hole 3120.

In the fourth embodiment, the rear high platform portion 311 functions as the unlock force-applying portion, makes the unlocking of the latching block 32 easy to operate.

Other structures of the fourth embodiment of the electrical connector in the present disclosure are substantially the same as those of the first embodiment, which are omitted herein.

Figure 13:
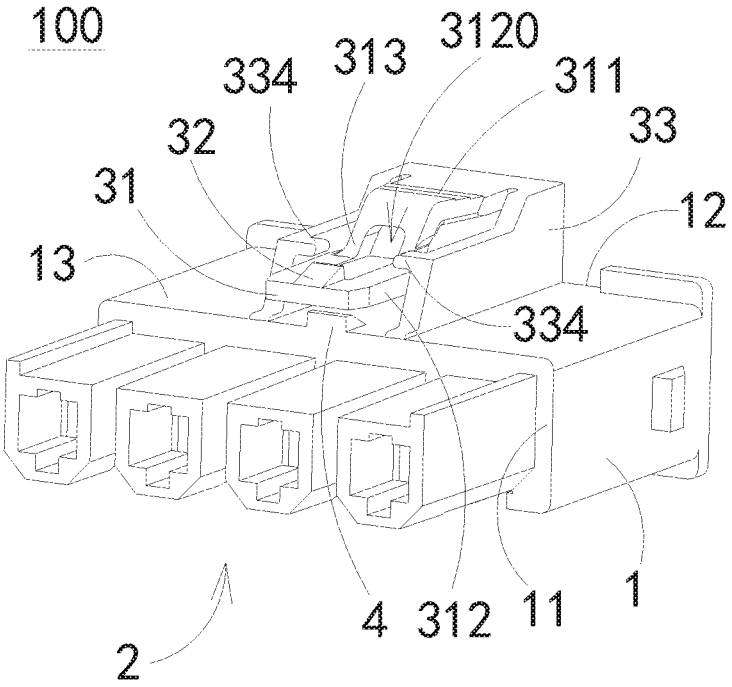
FIG. 13 is a perspective view of a fifth embodiment of the electrical connector in the present disclosure from an angle.
Figure 14:
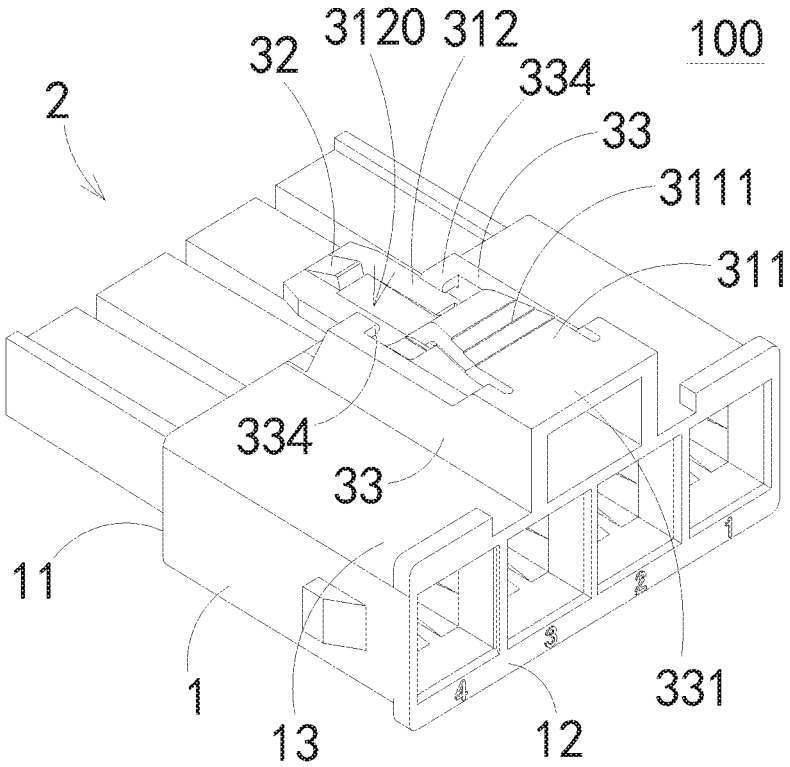
FIG. 14 is a perspective view of the electrical connector shown in FIG. 13 from another angle.

Referring to FIG. 13 to FIG. 14, FIG. 13 is a perspective view of a fifth embodiment of the electrical connector in the present disclosure from an angle; FIG. 14 is a perspective view of the electrical connector shown in FIG. 13 from another angle.

The difference between the fifth embodiment of the electrical connector in the present disclosure and the fourth embodiment lies in that: the two side barrier walls 33 are provided respectively with two upper limiting blocks 334 which are positioned above the upper surface of the latching arm 31 and face each other, the two upper limiting blocks 334 are positioned behind the latching block 32 and above the front low platform portion 312. The upper limiting block 334 may prevent the latching arm 31 from excessively warping upwardly and deformation or damage.

Other structures of the fifth embodiment of the electrical connector in the present disclosure are substantially the same as those of the fourth embodiment, which are omitted herein.

The electrical connector in the present disclosure, the top surface 13 of the insulating body 1 below the latching arm 31 is provided with the limiting block 4, the limiting block 4 functions as stopping, may prevent the latching arm 31 from being excessively pressed downwardly to cause deformation or damage of the latching arm 31.

Further, in some embodiments, the upper limiting block 334 positioned between the unlock force-applying portion and the latching block 32 functions as stopping, may prevent the latching arm 31 from being excessively pulled upwardly to cause deformation or damage of the latching arm 31. With the limiting block 4 and the upper limiting block 334, the displacement of the latching arm 31 in an up-down direction may be limited to prevent the latching arm 31 from deformation or damage. The side barrier walls 33 play a role of preventing the cable from entering into between the latching arm 31 and the top surface 13 of the insulating base portion 1, avoiding the risk of rupture of the latching arm 31 due to entanglement of a cable after the latching arm 31 is locked.

The above contents are only embodiments of the present disclosure and are not used to limit the implementing solution of the present disclosure, those skilled in the art may conveniently make corresponding variation or modification based on the main concept and spirit of the present disclosure, therefore the extent of protection of the present disclosure shall be determined by terms of the Claims.

What is claimed is:

1. An electrical connector which is configured to be mated with a mating connector to form an electrical connector assembly, the electrical connector comprising:

an insulating base portion having a front end, a rear end opposite to the front end and a top surface;

a mating portion integrally formed to the insulating base portion and extending forwardly from the front end of the insulating base portion, the mating portion configured to be mated with the mating connector;

a latching portion integrally formed to the top surface of the insulating base portion, the latching portion being configured to lock to a latching portion of the mating connector, the latching portion comprising:

a latching arm, a rear end of the latching arm being connected to a rear end of the top surface of the insulating base portion, and the latching arm extending forwardly with the rear end of the latching arm as a fulcrum to form a cantilever structure; and a latching block formed to a front end of the latching arm and protruding upwardly; and a limiting block provided on the top surface of the insulating base portion and positioned below the latching arm, the limiting block having a top face, wherein a first gap is provided between the top surface of the insulating base portion and a bottom surface of the latching arm, wherein a second gap is provided between the top face of the limiting block and the bottom surface of the latching arm, the second gap being less than the first gap, wherein the limiting block is used to limit a distance that the latching arm is displaced downwardly, and wherein the latching arm is a stepped elastic arm, and comprises a rear high platform portion, a front low platform portion and an inclined connecting portion connected between the rear high platform portion and the front low platform portion, the latching block is formed to the front low platform portion, a gap between the front low platform portion and the top surface of the insulating base portion is the first gap, a gap between the rear high platform portion and the top surface of the insulating base portion is a third gap, the first gap is less than the third gap.

2. The electrical connector of claim 1, wherein the latching portion further comprises two side barrier walls, the two side barrier walls are respectively positioned at a left side and a right side of the latching arm to cover at least a part of the first gap between the latching arm and the top surface of the insulating base portion.

3. The electrical connector of claim 2, wherein the two side barrier walls are provided respectively with two upper limiting blocks which are positioned above the upper surface of the latching arm and face each other, the two upper limiting blocks are positioned behind the latching block and above the front low platform portion.

4. The electrical connector of claim 1, wherein a long hole is provided on the inclined connecting portion and the front low platform portion, and the latching block is positioned in front of the long hole.

5. An electrical connector which is configured to be mated with a mating connector to form an electrical connector assembly, the electrical connector comprising:

an insulating base portion having a front end, a rear end opposite to the front end and a top surface;

a mating portion integrally formed to the insulating base portion and extending forwardly from the front end of the insulating base portion, the mating portion configured to be mated with the mating connector;

a latching portion integrally formed to the top surface of the insulating base portion, the latching portion being configured to lock to a latching portion of the mating connector, the latching portion comprising:

a latching arm, the latching is a stepped elastic arm and comprises a rear high platform portion, a front low platform portion and an inclined connecting portion connected between the rear high platform portion and the front low platform portion;

a latching block formed to the front low platform portion of the latching arm and protruding upwardly; and two side barrier walls, the two side barrier walls being respectively positioned at a left side and a right side of the latching arm, left and right sides of a rear end portion of the rear high platform portion are respectively connected to rear ends of the side barrier walls; and a limiting block provided on the top surface of the insulating base portion and positioned below the latching arm, the limiting block having a top face, wherein a first gap is provided between the top surface of the insulating base portion and a bottom surface of the front low platform portion of the latching arm, wherein a second gap is provided between the top face of the limiting block and the bottom surface of the latching arm, the second gap being less than the first gap, and wherein a third gap is provided between the top surface of the insulating base portion and a bottom surface of the rear high platform portion of the latching arm, the first gap being less than the third gap, and wherein the limiting block is used to limit a distance that the latching arm is displaced downwardly.

6. The electrical connector of claim 5, wherein the two side barrier walls are respectively positioned at a left side and a right side of the latching arm to cover at least a part of the first gap between the front low platform portion of the latching arm and the top surface of the insulating base portion.

7. The electrical connector of claim 5, wherein the two side barrier walls are provided respectively with two upper limiting blocks which are positioned above the upper surface of the latching arm and face each other, the two upper limiting blocks are positioned behind the latching block and above the front low platform portion.

8. The electrical connector of claim 5, wherein a long hole is provided on the inclined connecting portion and the front low platform portion, and the latching block is positioned in front of the long hole.

9. An electrical connector assembly, comprising:

an electrical connector; and a mating connector which is mated to the electrical connector, the mating connector having a latching portion, wherein the electrical connector comprises:

an insulating base portion having a front end, a rear end opposite to the front end and a top surface;

a mating portion integrally formed to the insulating base portion and extending forwardly from the front end of the insulating base portion, the mating portion mated with the mating connector;

a latching portion integrally formed to the top surface of the insulating base portion, the latching portion locked to the latching portion of the mating connector, the latching portion comprising:

a latching arm, the latching arm is a stepped elastic arm and comprises a rear high platform portion, a front low platform portion and an inclined connecting portion connected between the rear high platform portion and the front low platform portion;

a latching block formed to the front low platform portion of the latching arm and protruding upwardly; and two side barrier walls, the two side barrier walls being respectively positioned at a left side and a right side of the latching arm, left and right sides of a rear end portion of the rear high platform portion are respectively connected to rear ends of the side barrier walls; and a limiting block provided on the top surface of the insulating base portion and positioned below the latching arm, the limiting block having a top face, wherein a first gap is provided between the top surface of the insulating base portion and a bottom surface of the front low platform portion of the latching arm, wherein a second gap is provided between the top face of the limiting block and the bottom surface of the latching arm, the second gap being less than the first gap, and wherein a third gap is provided between the top surface of the insulating base portion and a bottom surface of the rear high platform portion of the latching arm, the first gap being less than the third gap, and wherein the limiting block is used to limit a distance that the latching arm is displaced downwardly.

* * * * *